United States Patent [19]

Franzen

[11] Patent Number: 4,574,570

[45] Date of Patent: Mar. 11, 1986

[54] APPARATUS FOR UNTWISTING A MULTI-PLY YARN OVER A PREDETERMINED PORTION THEREOF

[75] Inventor: Gustav Franzen, Willich, Fed. Rep. of Germany

[73] Assignee: Palitex Project Company-GmbH, Krefeld, Fed. Rep. of Germany

[21] Appl. No.: 679,230

[22] Filed: Dec. 7, 1984

[30] Foreign Application Priority Data

Dec. 15, 1983 [DE] Fed. Rep. of Germany ..... 3345403

[51] Int. Cl.[4] ..... D01H 7/00

[52] U.S. Cl. ..... 57/1 UN

[58] Field of Search ..... 57/1 R, 1 UN, 2.3, 204, 57/264, 283, 293, 309, 336

[56] References Cited

U.S. PATENT DOCUMENTS

| | | | |
|---|---|---|---|
| 3,415,048 | 12/1968 | Welbers | 57/293 X |
| 3,434,275 | 3/1969 | Backer et al. | 57/293 X |
| 3,813,862 | 6/1974 | Tsuchida | 57/1 UN |
| 3,925,975 | 12/1975 | Stahlecker et al. | 57/1 UN X |

*Primary Examiner*—Donald Watkins

*Attorney, Agent, or Firm*—Bell, Seltzer, Park & Gibson

[57] ABSTRACT

An apparatus for untwisting a multi-ply yarn over a predetermined portion of the length thereof has an untwisting element provided with two contact surfaces which face one another and between which the multi-ply yarn is guided and whose mutual spacing is greater than the thickness of each of the individual strands forming the multi-ply yarn and smaller or equal to the thickness of the multi-ply yarn, at least along a line transversely of the longitudinal direction of the multi-ply yarn. The contact surfaces are displaced relative to one another in mutually opposing directions transversely of the longitudinal direction of the multi-ply yarn. Torque is then relay transmitted to the multi-ply yarn and leads to the untwisting of the multi-ply yarn. The untwisting operation terminates automatically when the multi-ply yarn is fully untwisted between the two contact surfaces and the two strands are located parallel to one another, since the gap between the two contact surfaces is larger than the diameter of the strands of the yarn and torque is no longer transmitted.

13 Claims, 9 Drawing Figures

APPARATUS FOR UNTWISTING A MULTI-PLY YARN OVER A PREDETERMINED PORTION THEREOF

The invention relates to a device for untwisting a multi-ply yarn over a predetermined portion of the length thereof.

An object of the present invention is to provide an apparatus in which the multi-ply yarn is untwisted over a predetermined portion of its length by purely mechanical means.

The present invention resides in an apparatus for untwisting a multi-ply yarn over a predetermined portion of the length thereof, comprising a fixed clamping device for holding the multi-ply yarn at one end of said predetermined portion of its length, and an untwisting element at the other end of said predetermined portion, said untwisting element having two mutually facing contact surfaces between which the multi-ply yarn is guided and whose mutual spacing is greater, at least along a line transversely of the longitudinal direction of the multi-ply yarn, than the thickness of each of the two individual yarns forming the multi-ply yarn and is smaller or equal to the thickness of the multi-ply yarn, the contact surfaces being displaceable relative to one another in mutually opposite directions with the retention of their mutual spacing over at least the distance necessary for fully untwisting said portion of the multi-ply yarn, taking into account the diameter of the multi-ply yarn.

The invention is based on the result that, in an apparatus having the features of the invention, the untwisting operation over said predetermined portion terminates automatically when the end of the multi-ply yarn clamped between the contact surfaces of the untwisting element no longer exhibits any twist. An will be explained in greater detail below with reference to preferred embodiments, the untwisted individual strands of the multi-ply yarn are in this case located parallel to one another between the contact surfaces, and, since the thickness of these individual strands is smaller than the thickness of the multi-ply yarn to which the predetermined distance between the contact surfaces is adjusted, can no longer fill the gap established between the contact surfaces. Consequently, the contact surfaces moving relative to one another cannot transmit any further turning movement to the multi-ply yarn. Hence, the two individual strands automatically terminate the untwisting operation. For this reason there is no need for any critical adjustment of the relative displacement distance for the two contact surfaces, provided such displacement is sufficiently large and, basically, can also be chosen to be considered larger than the minimum distance required for untwisting.

The contact surfaces can be aligned parallel to one another. Alternatively, they can be disposed such that a tapered gap is produced between the straight or convex surfaces disposed at an angle relative to one another. Hence, it is possible for the end of the multi-ply yarn to enter the wider opening gap, so that the untwisting operation can terminate abruptly at a predetermined location.

Furthermore, it may also be advantageous to associate with the apparatus in accordance with the invention a device by which the termination of the untwisting operation can be established. The entire apparatus can then be switched off by means of such a device when the untwisting operation has terminated. This associated device can also count and store the sum of the number of revolutions of the untwisting multi-ply yarn.

The contact surfaces can be disposed on mutually displaceable plates or, alternatively, on belts which are movable relative to one another, in the manner of a rubbing mechanism.

Advantageously, the apparatus in accordance with the invention can be used in methods for joining two ends of a ply yarn, in which the yarn twist is first removed from the multi-ply yarn over a predetermined portion thereof (see German Offenlegungsschrift No. 32 43 410). It may also be used in measuring technology, such as in methods of testing the twist.

The invention will be further described hereinafter by way of example, with reference to the accompanying drawings, in which.

Figure 1:
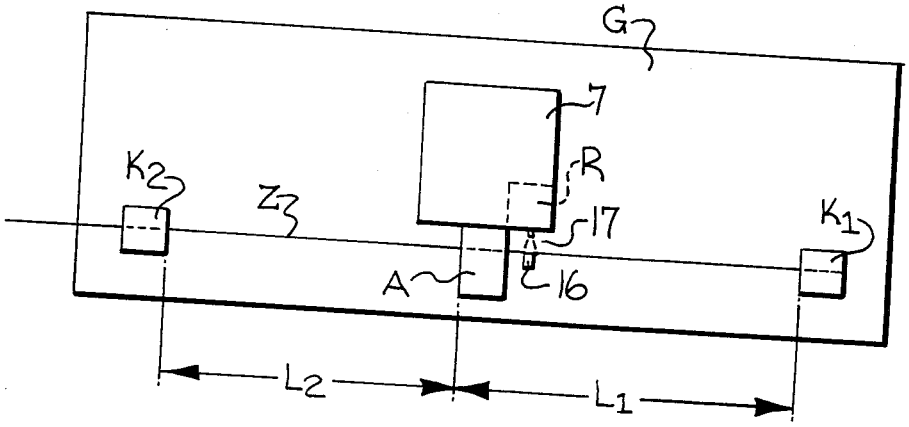
FIG. 1 is a diagrammatic plan view of an apparatus for untwisting a multi-ply yarn.

The apparatus, shown in its entirety in FIG. 1, for untwisting a multi-ply yarn has a base plate G on which are disposed two clamping devices K1, K2 by which the end of a multi-ply yarn Z is guided and clamped. An untwisting element A, which will be further described hereinafter, is disposed in a housing 7 between the two clamping devices K1, K2, and immediately adjacent thereto a device R for detecting turning movement of the multi-ply yarn. The device R includes a marker element secured to the multi-ply yarn and is in the form of a known optical reflex light barrier.

Figure 9:
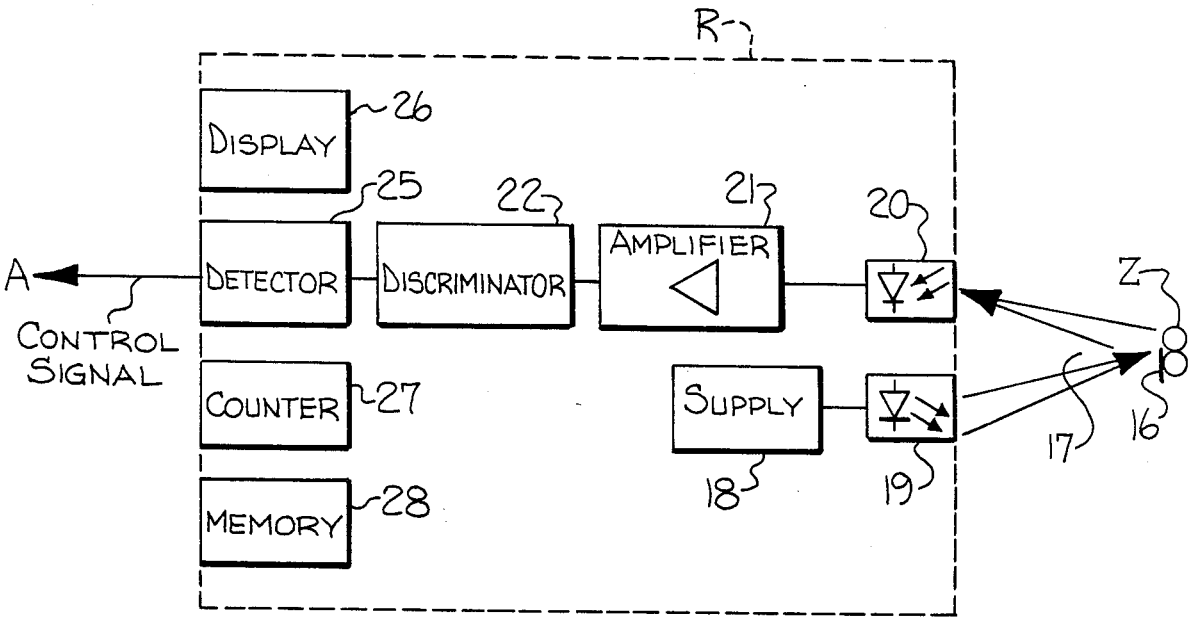
FIG. 9 is a diagrammatic illustration of a portion of the apparatus of FIG. 1, having a device for detecting rotation of the multi-ply yarn.

An embodiment of the device R for the detection of rotation of the multi-ply yarn is shown in greater detail in FIG. 9 in the form of a basic circuit diagram. As is also shown in FIG. 1, a marking element 16 is disposed on the multi-ply yarn Z. By way of example, the marking element 16 may be a weak clamp having a light-reflecting surface. Alternatively, however, it is possible to apply a small quantity of light-reflecting material directly to the multi-ply yarn at this location. The optical reflex light barrier 17 is produced by a light source 19 which may be a light-emitting diode and which is supplied with electrical power by a supply device 18. A beam of light from the light source 19 impinges on the multi-ply yarn Z shown in cross section in FIG. 9, and a portion of the incident light is reflected by the marking element 16. The reflected beam of light falling in a predetermined angular range is received by a light detector 20, such as a photodiode. As long as the multi-ply yarn Z is rotating, the luminous flux striking the light detector 20 varies periodically and produces an electrical signal which is fed to a discriminator 22 by way of an amplifier 21. This discriminator can include a pulse-shaper stage and a threshold value detector in a known manner, so that only those signals are transmitted which exceed a predetermined lower limit. If necessary, a high-pass filter can also be interposed, so that signals which vary very slowly with respect to time are suppressed.

A detector circuit 25 detects from the signals supplied by the discriminator circuit 22 whether the multi-ply yarn Z is rotating and supplies a corresponding signal to a display 26 and to a counter 27 in which the number of twists is ascertained and transmitted to a memory 28. When the detector circuit 25 no longer detects rotation of the multi-ply yarn Z, a control signal is produced and can be used to switch off the untwisting element A.

It is pointed out that it is also possible to use the optical reflex light barrier 17 without disposing an individual marking element 16 on the multi-ply yarn Z. That is to say, a portion of the light beam transmitted by the light source 19 is continously reflected towards the light detector 20 from the surfaces of the yarns forming the multi-ply yarn and, by reason of the irregular structure of the rotating yarns, the incident luminous flux will continuously change as long as the multi-ply yarn is rotating. The incoming light signal will only change slightly as soon as the rotary movements cease. Hence, a periodically varying signal can also be produced in this manner and can be further processed in the manner described above and can be used to indicate the rotation of the multi-ply yarn.

Finally, it is also possible for the device R to be a purely mechanical device and not an optical reflex light barrier. Hence, by way of example, a small, readily movable wheel may be used which is pressed laterally against the multi-ply yarn Z and whose rotary movement can also be detected by, for example, an inductive sensor.

The untwisting of the multi-ply yarn is to be effected over the portion L1 of its length between the untwisting element A and the end of the multi-ply yarn clamped in the clamping device K1.

Figure 2:
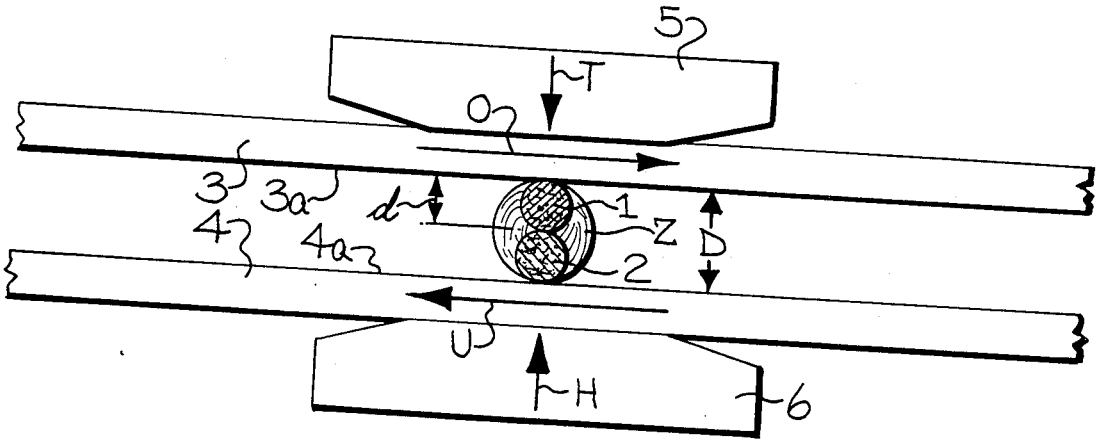
FIG. 2 is a view, in the longitudinal direction of the multi-ply yarn, of an untwisting element for the apparatus of FIG. 1, before termination of an untwisting operation.
Figure 3:
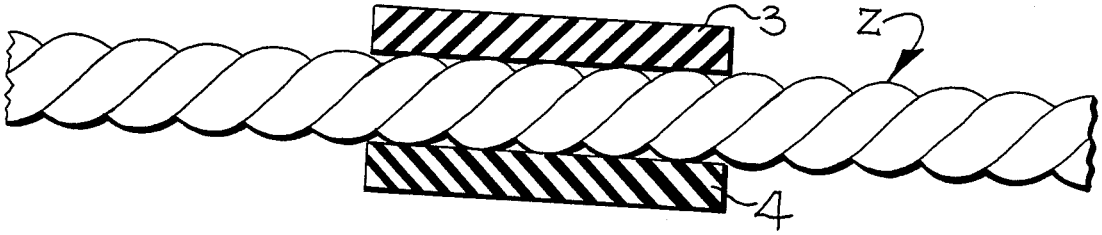
FIG. 3 is a view, transversely of the longitudinal direction of the multi-ply yarn, of the untwisting element of FIG. 2.
Figure 4:
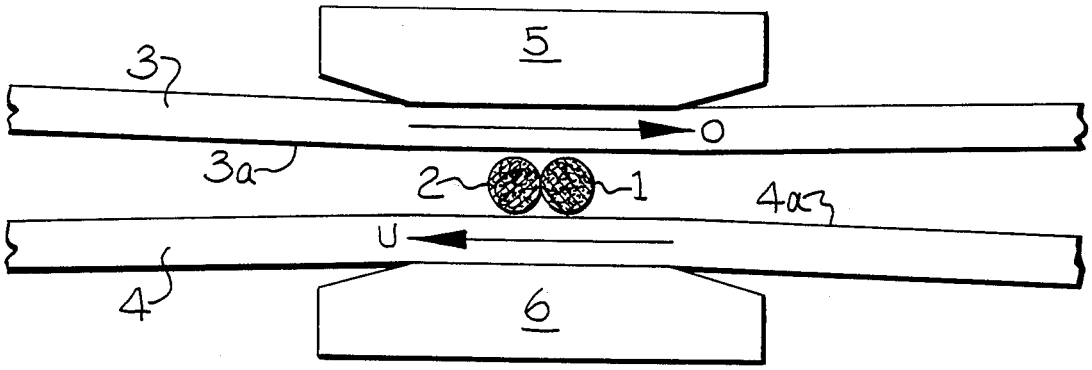
FIG. 4 is a view, analogous to FIG. 2, after termination of the untwisting operation.
Figure 5:
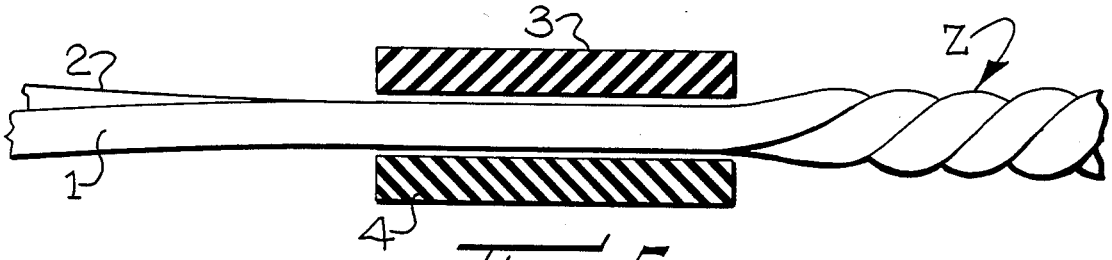
FIG. 5 is an illustration, analogous to FIG. 3, after termination of the untwisting operation.

This untwisting operation will be explained with reference to FIGS. 2 and 5.

The multi-ply yarn Z, comprising two yarn strands 1 and 2, is disposed between two contact surfaces 3*a*, 4*a* of the untwisting element A. As will be described further below with reference to FIG. 8, these contact surfaces 3*a* and 4*a* are located on mutually oppositely located portions 3 and 4 of a circulating endless belt B. The two belt portions 3 and 4 run across mutually oppositely located guide plates 5 and 6 whose distance apart is variable in the directions of the arrows H and T. The guide plates 5 and 6 are adjusted in such a way that the distance between the two contact surfaces 3*a* and 4*a* is equal to, or slightly smaller than, the diameter D of the twisted multi-ply yarn Z. The diameter of the individual yarn strands 1 and 2 is designated d.

The belt portions 3 and 4 are now moved in the directions O and U at a predetermined speed. Torque is transmitted to the multi-ply yarn Z, and rotation of the multi-ply yarn is effected in such a way that the multi-ply yarn is untwisted in the portion L1 (FIG. 1), while an additional twist is introduced into the portion L2, or vice versa. Hence, a false twist is produced.

When the multi-ply yarn has been completely untwisted over the portion L1 (or L2), the two individual yarn strands 1 and 2 are located parallel to one another between the contact surfaces 3*a* and 4*a*. Since the thickness d of the yarn strands 1 or 2 is smaller than the distance between the two contact surfaces 3*a* and 4*a*, no further twist can be imparted to the ply yarn from this instant onwards. Hence, the untwisting operation is terminated even when the two belt portions 3 and 4 continue to move in the directions O and U.

This means that it is not essential accurately to monitor the termination of the untwisting operation to ensure that the multi-ply yarn is not, for example, twisted again in the other direction. It is sufficient to stop the movement of the two belt portions 3 and 4 when it is ensured that the untwisting operation has terminated. This can be effected by, for example, the device R which establishes that no further twist or rotation is taking place in the portion L1, and the device then is switched off again.

However, it is sufficient also to perform the mutual displacement of the belts 3, 4 to an extent that, solely on the basis of the number of twists originally existing in the yarn portion L1 and taking into account the original diameter of the multi-ply yarn, it is ensured that the multi-ply yarn has been rolled a sufficient amount to completely untwist it.

Figure 6:
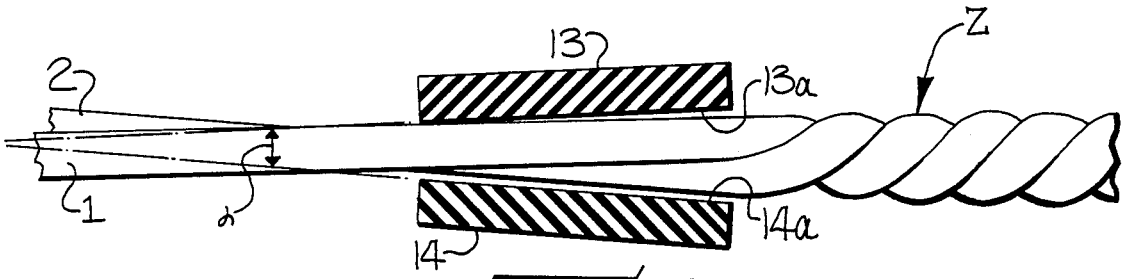
FIG. 6 is a view, analogous to FIG. 5, of a variant of the untwisting element having contact surfaces which slope relative to one another.

FIG. 6 shows a somewhat different embodiment of the untwisting element A, in which the two belt portions 13 and 14 (here also, plates, on which the contact surfaces 13*a* and 14*a* are disposed, can be used) form a small acute angle in such a way that a conical or tapered gap is formed which opens into a direction away from the portion L1 to be untwisted.

Figure 7:
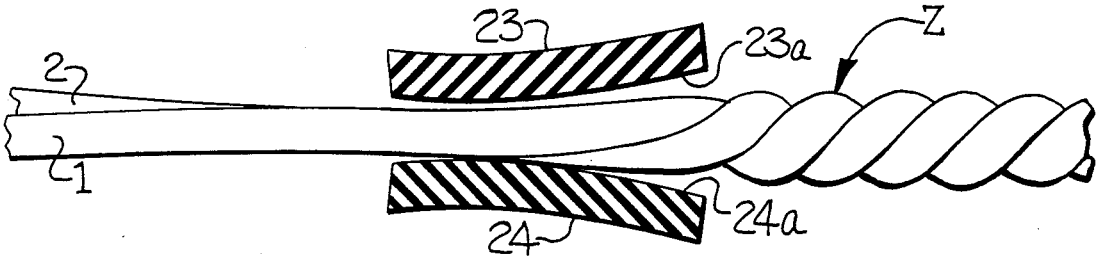
FIG. 7 is a view, analogous to FIG. 5, of a further variant of an untwisting element having convexly curved contact surfaces.

Alternatively, instead of the contact surfaces 13*a* and 14*a* which are inclined to one another at an acute angle, convex contact surfaces 23*a* and 24*a* can be disposed on belt portions or plates 23 and 24 and also form a gap which opens conically or divergently in a direction away from the portion L1 to be untwisted, as is shown in FIG. 7. Strictly speaking, in these embodiments the above-mentioned distance condition is only fulfilled for a line in a direction transversely of the longitudinal direction of the multi-ply yarn. This means that the untwisting of the multi-ply yarn is terminated immediately when the individual yarn strands 1 and 2 are located adjacent to one another at this location and no longer fill the space between the contact surfaces.

Figure 8:
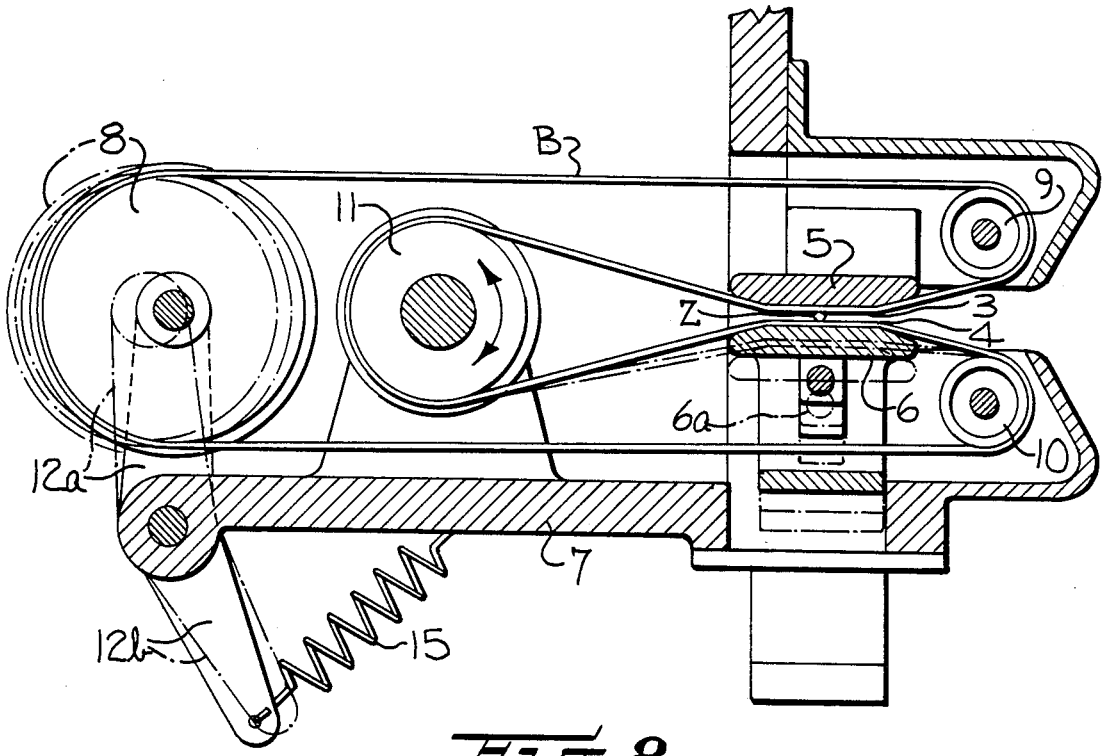
FIG. 8 is a cross section, transversely of the longitudinal direction of the multi-ply yarn, of an untwisting element having a circulating endless belt.

FIG. 8 shows an embodiment of the untwisting element A having a circulating belt B which is guided around guide rollers 8, 9, 10 and 11 which are disposed within a housing 7 and which are arranged in such a way that two portions 3 and 4 of the same surface of the belt B are located opposite one another. The distance between the two belt portions 3 and 4 is variable by means of guide plates 5 and 6 which are displaceable relative to one another. For this purpose, the plate 6 is displaceably guided in a guide 6*a*.

In order to maintain the required tension of the belt even during displacement of the belt portions 3 and 4 relative to one another, the guide roller 8 is pivotally disposed on a two-armed lever 12*a* and 12*b* on the housing, the arm 12*b* of the two-armed lever being supported on the housing 7 by means of a spring 15. The multi-ply yarn Z is guided through between the belt portions 3 and 4. When the belt B is circulating, the belt portions 3 and 4 move in opposite directions to one another transversely of the longitudinal direction of the multi-ply yarn, and a torque is transmitted to the multi-ply yarn Z in the manner described with reference to FIGS. 2 to 5.

In an alternative arrangement, the belt portions 3, 4 having the contact surfaces 3*a*, 4*a* are portions of two separate endless belts.

In preferred embodiments, the coefficient of friction of the contact surfaces 3*a*, 4*a*, 13*a*, 14*a*, 23*a*, 24*a* varies transversely of the multi-ply yarn Z.

That which is claimed is:

1. An apparatus for untwisting a multi-ply yarn over a predetermined portion of the length thereof, comprising a fixed clamping device for holding the multi-ply yarn at one end of the predetermined portion of its length, and means for untwisting the yarn positioned at the other end of the predetermined portion of its length, said untwisting means having two mutually facing contact surfaces between which the multi-ply yarn is guided and whose mutual spacing is greater, at least along a line transversely of the longitudinal direction of the multi-ply yarn, than the thickness of each of the two individual yarns forming the multi-ply yarn and is smaller or equal to the thickness of the multi-ply yarn, said contact surfaces being movable relative to one another in mutually opposite directions with the retention of their mutual spacing over at least the distance necessary for fully untwisting the predetermined portion of the length of the multi-ply yarn, taking into account the diameter of the multiply yarn.

2. An apparatus as claimed in claim 1, in which said contact surfaces are parallel to one another.

3. An apparatus as claimed in claim 1, in which said contact surfaces are at a small, predetermined acute angle to one another in the longitudinal direction of the multi-ply yarn.

4. An apparatus as claimed in claim 1, in which said contact surfaces, opening in the longitudinal direction of the multi-ply yarn, are curved.

5. An apparatus as claimed in claim 1, further comprising a device for detecting a turning movement of the multi-ply yarn at a predetermined point of said portion of the length to be untwisted.

6. An apparatus as claimed in claim 5, in which the device for detecting a turning movement of the multi-ply yarn includes a device for counting and storing the number of full revolutions of the ply yarn.

7. An apparatus as claimed in claim 5, in which the device for detecting the turning movement is disposed directly adjacent the untwisting element.

8. An apparatus as claimed in any of claims 5, 6 or 7, in which the device for detecting the turning movement has a marker element secured to the portion of the multi-ply yarn to be untwisted.

9. An apparatus as claimed in claim 8, in which the device for detecting the turning movement includes an optical reflex light barrier.

10. An apparatus as claimed in claim 1, 2, 3 or 4, in which the coefficient of friction of said contact surfaces with the yarn varies in a direction transversely of the longitudinal direction of the multi-ply yarn.

11. An apparatus as claimed in claim 1, 2, 3 or 4, in which said contact surfaces comprise mutually oppositely located portions of movable belt means.

12. An apparatus as claimed in claim 1, 2, 3 or 4, in which said contact surfaces comprise mutually oppositely located portions of a circulating endless belt.

13. An apparatus as claimed in claim 12, in which said untwisting means further includes oppositely positioned guide plates having means for varying the spacing therebetween, and in which said contact surfaces are formed on moving endless belt means passing over said guide plates.

* * * * *